US005385443A

United States Patent [19]

Dufour

[11] Patent Number: 5,385,443

[45] Date of Patent: Jan. 31, 1995

[54] CENTRIFUGAL LIQUID PUMP WITH INTERNAL GAS INJECTION ASSEMBLY

[75] Inventor: Reneau Dufour, Breakeyville, Canada

[73] Assignee: Les Traitements des eaux Poseidon Inc., Outremont, Canada

[21] Appl. No.: 134,591

[22] Filed: Oct. 12, 1993

[51] Int. Cl.[6] ..... F04D 31/00

[52] U.S. Cl. ..... 415/116; 415/188; 415/170.1; 261/87; 277/72 R; 277/74

[58] Field of Search ..... 415/1, 115, 116, 117, 415/185, 186, 188, 199.1, 199.2, 199.3, 206, 170.1, 174.2; 261/87, 28; 277/16, 72 R, 74, DIG. 8

[56] References Cited

U.S. PATENT DOCUMENTS

| | | | |
|---|---|---|---|
| 561,126 | 6/1896 | Pendleton | 261/87 |
| 2,325,477 | 7/1943 | Collins | 415/116 |
| 2,471,653 | 5/1949 | Price | 415/189 |
| 2,542,492 | 2/1951 | Entwistle et al. | 261/87 |
| 2,569,997 | 10/1951 | Kollsman | 415/117 |
| 2,874,894 | 2/1959 | Goldschmied | 415/116 |
| 3,123,651 | 3/1964 | Gross et al. . | |
| 3,485,484 | 12/1969 | Quinchon . | |
| 3,719,434 | 3/1973 | Eskell . | |
| 4,018,859 | 4/1977 | Muller | 261/87 |
| 4,255,081 | 3/1981 | Oklejas et al. . | |
| 4,474,722 | 5/1988 | Sampi et al. . | |

FOREIGN PATENT DOCUMENTS

| | | |
|---|---|---|
| 165800 | 11/1952 | Australia . |
| 1016408 | 8/1977 | Canada . |
| 1151006 | 8/1983 | Canada . |
| 1157315 | 11/1983 | Canada . |
| 1249508 | 1/1989 | Canada . |
| 2086554 | 1/1992 | Canada . |

*Primary Examiner*—Edward K. Look
*Assistant Examiner*—Christopher Verdier
*Attorney, Agent, or Firm*—ROBIC

[57] ABSTRACT

Disclosed is a centrifugal liquid pump, preferably of the rotary disc type, which incorporates a gas injection assembly of very simple yet efficient structure, whereby up to 15% per volume of a gas such as air, may be mixed with the pumped liquid. The gas injection is achieved with a gas feed pipe that enters the pump through its axial inlet and with a plurality of gas injector pipes that projects from the gas feed pipe radially within the impeller.

18 Claims, 4 Drawing Sheets

CENTRIFUGAL LIQUID PUMP WITH INTERNAL GAS INJECTION ASSEMBLY

BACKGROUND OF THE INVENTION a) Field of the Invention

The present invention relates to a method for injecting and dissolving a gas, such as air, into a liquid that is preferably water, while this liquid is being pumped by a centrifugal pump, that is preferably of the rotary disc type.

The invention also relates to a centrifugal liquid pump, preferably of the rotary disc type, incorporating a gas injection assembly.

b) Brief Description of the Prior Art

In the flotation processes that are presently used for "clarifying" or otherwise treating waste water it is of common practice to recycle part of the clarified water. Usually, the clarified water is pumped at the bottom of the flotation tank of the clarifier or at the outlet of the same and injected into the waste water to be treated just before it enters the clarifier.

It is also of common practise to inject air into the waste water that enters the clarifier, in such a manner as to generate a multitude of very small bubbles which "catch" the solids in suspension in the waste water and thus favorize flotation of the same. Such an injection can be made either directly into the waste water fed to the clarifier, just before it enters the same, or preferably into the clarified water that is recycled prior to its injection into the waste water. In both cases, the injection is preferably made under pressure so as to dissolve as much air as possible in the water.

In order to recycle a sufficient amount of clarified water and simultaneously allow dissolution therein of a sufficient amount of air to generate a multitude of micro bubbles of 150$\mu$or less as soon as the pressure is released, the pump must ideally generate a pressure of 80 to 120 lbs. Of course, it must also have ideally a low energy consumption (expressed in $m^3$ per horse power).

To meet these goals, use has been made so far of centrifugal multistage pumps with bladed impellers that can build up pressure up to 200 lbs. However, these pumps have a low flow rate.

It has also been suggested to use rotary disc pumps comprising a plurality of closely spaced apart discs rotatably mounted within a casing (see for example U.S. Pat. Nos. 4,335,996; 4,514,139; 4,768,920 and 4,773,819). In this particular case, the pumping effect is obtained by frictional and shear forces developed between the rotating discs and the fluid. To improve such an effect, it has also been suggested to provide radial straight ribs on each disc (see U.S. Pat. No. 4,940,385).

Rotary disc pumps are interesting in that, thanks to their structure, they can easily handle a fluid such as waste water, which may contain solids in suspension. However, they are really effective only when the pressure to be built up is lower than 50 lbs. Moreover, they are known to be energy consuming (maximum of 1 $m^3$/HP).

To provide the required dissolution of air in the recycled water (or in the waste water fed into the clarifier), it is of common practice to provide an air inlet in a venturi located upstream the pump, so as to suck air with and into the water and to compress with the same within the pump (see, for example, Canadian patent No. 1,016,408, even if it is directed to another application).

In this very specific field, it has also been suggested to inject air directly within the casing of the pump, either through conducts made in the blades of the impeller and opening at the outer ends of these blades (see U.S. Pat. No. 3,485,484) or through stationary pins extending in the casing of the pump, the blades of the rotor then being split at a given radial distance from their rotation axis not to interfere with the pins (see U.S. Pat. No. 4,744,722). In both of these cases, the casing and/or the impeller or rotor is/are of very specific structure, thereby making the pump rather expensive and its structural components sometimes difficult to repair and/or easily interchange.

It is known that with bladed impeller multistage pumps capable of building up high pressure it is possible to mix up to 20% per volume of air in the water flow. With the existing rotary disc pumps which cannot build up high pressure, one may mix up to 7% per volume of air only, and only if the discs are close to each other and rotate at a speed of 1700 to 2100 rpm. However, in practice, from 10 to 15% per volume of air are required to make the waste water treatment efficient in the clarifier.

OBJECTS AND SUMMARY OF THE INVENTION

An object of the invention is to provide a centrifugal liquid pump, preferably of the rotary disc type, which incorporates a gas injection assembly of very simple yet efficient structure, whereby up to 15% per volume of a gas such as air, may be mixed with the pumped liquid.

The centrifugal pump used in accordance with the invention is of conventional structure and comprises:

a) a casing defining an inner, substantially cylindrical chamber that has a pair of opposite end walls coaxial with each other;

b) a liquid inlet in open communication with the chamber, this inlet being coaxial with the chamber and opening into one of the opposite end walls thereof;

c) a liquid outlet in open communication with the chamber, this outlet extending tangentially out of the chamber;

d) a rotary impeller rotatably mounted within the chamber, this impeller comprising a pair of spaced apart discs of a given radius that are coaxial with the chamber and are rigidly interconnected at such a distance away from each other as to extend close to the opposite end walls, respectively, one of the discs located adjacent the one opposite end wall into which the liquid inlet opens having a central opening to allow the liquid injected through the inlet to enter the chamber; and e) a power shaft coaxial with and rigidly connected to the other one of the discs so as to rotate the impeller within the chamber, this power shaft extending out of said casing in a direction opposite to the liquid inlet.

The gas injection assembly used in accordance with the invention to inject and dissolve, at least in part, a gas into the liquid while the same is being pumped by the pump comprises:

f) a gas feed pipe coaxial with and rigidly connected to the impeller so as to rotate therewith, this gas feed pipe extending coaxially through both the liquid inlet and the opening of the one disc of the impeller in a direction opposite to the power shaft and having a gas inlet located outside the casing and connectable through a rotary seal joint to a pressurized gas source, and a gas outlet located within the casing; and g) at least one and preferably three to five gas injector pipes rigidly connected to the gas feed pipe so as to rotate in unison therewith and with the impeller to which the gas feed pipe is connected, each injector pipe being perpendicular to the feed pipe and extending radially within the casing between the discs of the impeller, each injector pipe having one end in open communication with the gas outlet of the feed pipe and another radially, opposite end defining a gas nozzle opening within the casing between the discs at a radial distance away from the feed pipe that is shorter than the radius of the discs.

As can be appreciated, the gas injection assembly used in accordance with the invention is of very simple structure and can be incorporated into the structure of the pump without any major modification to be made in the same. Indeed, the gas feed pipe enters the pump through its inlet and thus does not call for any additional opening to be made in the casing of the pump. Moreover, the injector pipes extends radially between the discs within the impeller and thus do not call for any openings, slots or internal passages to be made in the discs or other components of the rotor. As a result, the investment and maintenance costs are reduced to a minimum.

In accordance with a first preferred embodiment of the invention, the impeller may comprise vanes that are connected to the discs and extend radially outwardly away from the opening made in the one disc in such a manner as not to interfere with the gas injector pipes extending between the discs. In such a case, the pump is of the conventional, "bladed-impeller" type.

In accordance with a second, much preferred embodiment of the invention, the discs of the impeller are connected to each other by a plurality of small rods and have opposite flat surfaces which face each other and on which a plurality ribs extend. The ribs project from the discs at such a distance as to leave a gap in between and then to give room to the gas injector pipes and are preferably thick, and high, volute-shaped radially outwardly curved in a direction opposite to the direction in which the impeller is rotated. In such a case, the pump is of the "rotary disc" type and has the main advantage of leaving a gap between the discs through which large particles in suspension in the pumped liquid may pass.

As can be appreciated, the above described centrifugal pump with its incorporated gas injection assembly can be used to inject any kind of gas into any kind of liquid while the same is being pumped. A preferred application of the invention is however to use the above combination to inject air into clarified or waste water.

As can also be appreciated, the length of the gas injector pipes may vary depending on the application. The shorter are the gas injector pipes, the lower will be the pressure required for injecting air into the pump. However, the longer are the gas injectors, the higher will be the pressure required for injecting air and consequently the amount of air injected into the pump.

Tests carried out by the Applicant have shown that a centrifugal pump of the rotary disc type as disclosed hereinabove incorporating a gas injection assembly as also disclosed hereinabove could easily build up a pressure of 80 to 140 lbs and allow injection and dissolution of up to 15% by volume of air into the pumped water, thereby allowing the formation of very efficient microbubbles of a few tenths of a micron. Moreover, the flow rate of the pump was appropriate and the energy consumption much better than expected (more than 2 $m^2$/HP).

In accordance with the invention, there is also provided a very efficient yet simple method for injecting and dissolving a gas, especially air, into a liquid like waste or clarified water while this liquid is being pumped, which method is particularly interesting in that it calls for standard component readily available to anyone to carry it out.

The method according to the invention comprises the steps of:

a) feeding the liquid to be pumped into a centrifugal pump comprising an impeller consisting of two coaxial discs having facing surfaces which are spaced apart and from which ribs project at such a distance as to leave a gap therebetween and; at the same time b) feeding under pressure the gas to be injected and dissolved through at least two symmetrically positioned gas injector pipes extending radially in the gap left between the discs, the pipes being rigidly connected to the impeller so as to rotate in unison therewith.

Once again, the gas is preferably air and the liquid waste or clarified water even though this method could be used with other gas and liquids.

BRIEF DESCRIPTION OF THE DRAWINGS

The invention and its advantages will be better understood upon reading the following, non-restrictive description of two preferred embodiments thereof, made with reference to the accompanying drawings in which.

DESCRIPTION OF TWO PREFERRED EMBODIMENTS

In the following description, reference will be made exclusively to water as the liquid to be pumped and air as the gas to be injected into the pumped liquid. It is worth mentioning however that the invention is not restricted to the injection of air into water, especially waste or clarified water, and may actually be used to inject other gases into other liquids.

Figure 1:
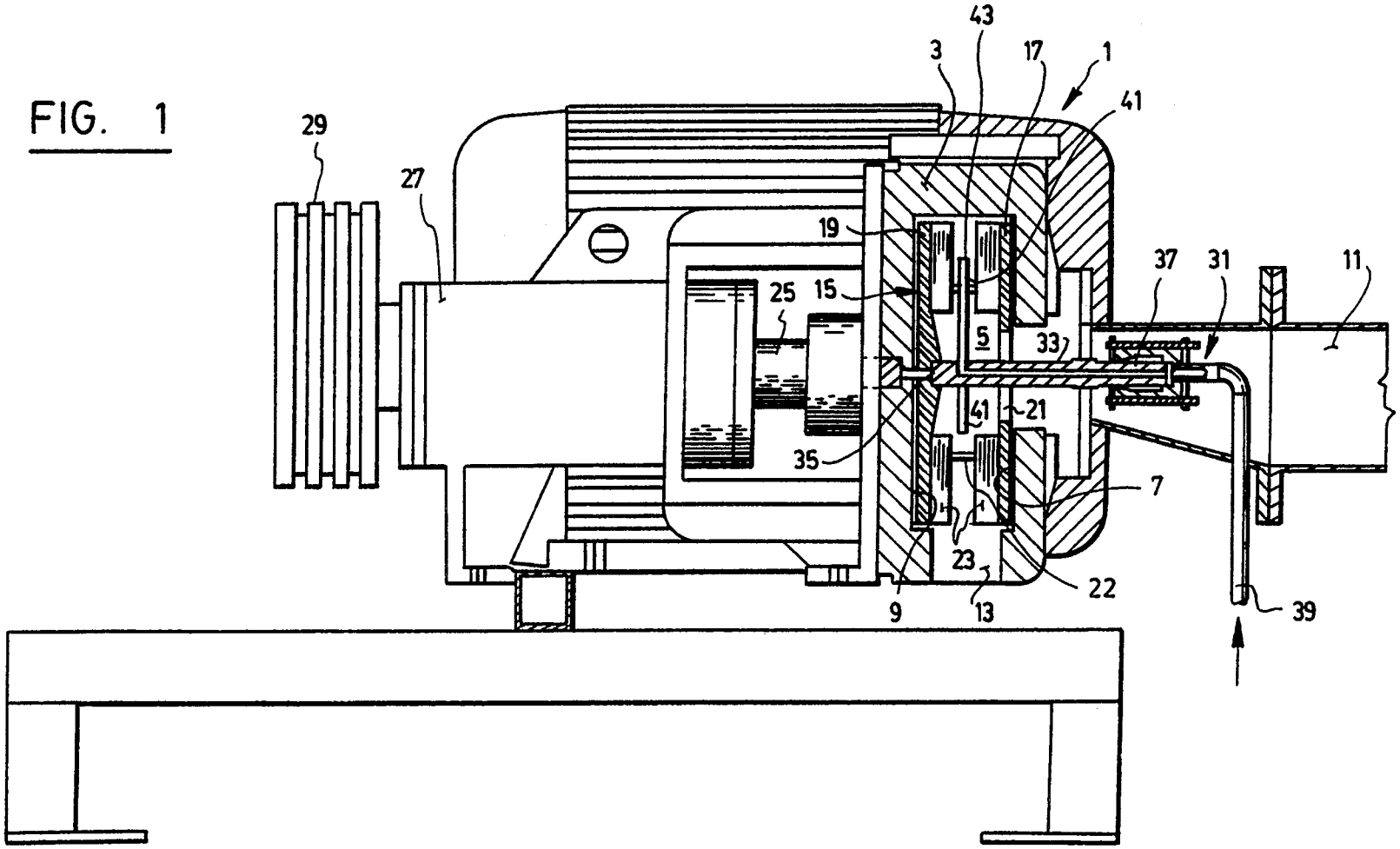
FIG. 1 is a side elevational view, partly in cross-section, of a centrifugal pump of the rotary disc type, incorporating a gas injection assembly according to the invention.
Figure 2:
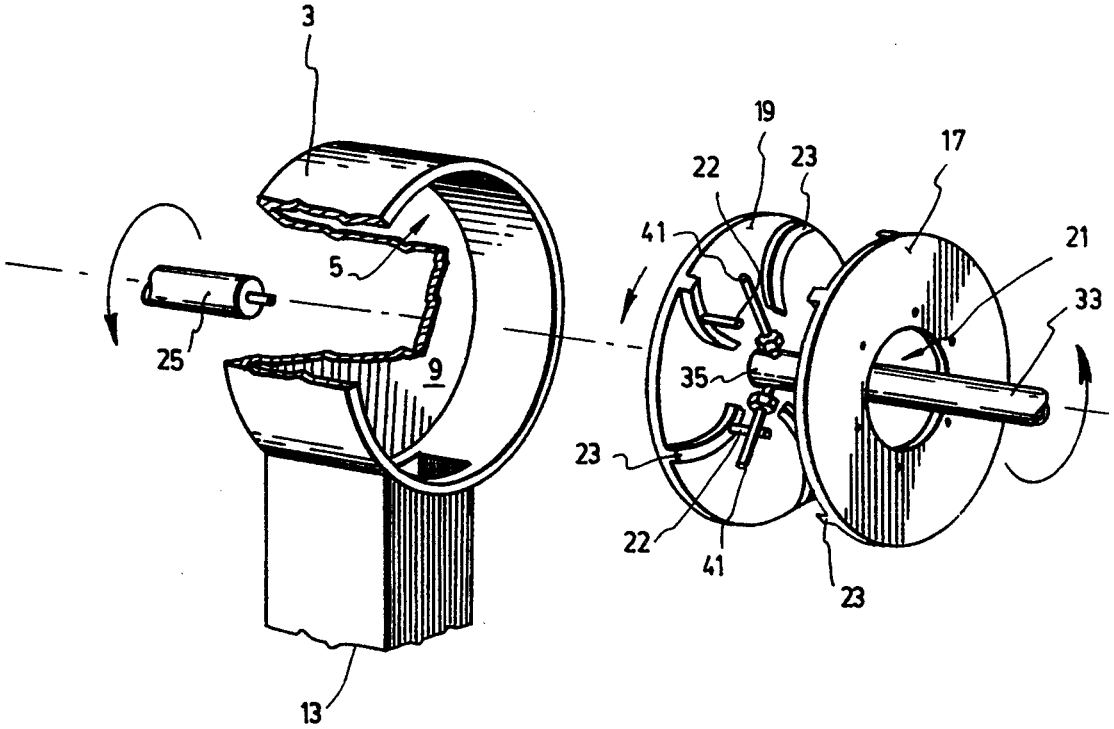
FIG. 2 is an exploded perspective view of the casing impeller of and gas injection assembly of the pump shown in FIG. 1.

The centrifugal liquid pump 1 used in accordance with a first embodiment of the invention shown in FIGS. 1 and 2, is of the "rotary disc" type. It comprises a casing 3 defining an inner, substantially cylindrical chamber 5 having a pair of opposite end walls 7, 9 coaxial with each other. The casing 3 is provided with a liquid inlet 11 that is coaxial with the chamber 5 and opens into one of the opposite end walls, e.g. the one numbered 7. The casing 3 also comprises a liquid outlet 13 that is in open communication with the chamber 5 and extends tangentially out of the same.

A rotary impeller 15 is rotatably mounted within the chamber 5. This impeller 15 comprises a pair of spaced apart discs 17, 19 of a given radius that are coaxial with the chamber. The discs 17, 19 are connected to each other by a plurality of small rods 22 at such a distance away from each other as to extend close to the opposite end walls, respectively. The disc 17 that is located adjacent the opposite end wall 7 into which the liquid inlet opens, has a central opening 21 to allow the liquid injected through the inlet 11 to enter the chamber 5. Both discs 17, 19 have flat surfaces which face each other and on which a plurality ribs 23 extend. As is clearly shown in FIG. 1, the ribs 23 project from the discs at such a distance as to leave a gap in between. As is better shown in FIG. 2, the ribs 23 are thick and high, volute-shaped and curved radially outwardly in a direction opposite to the direction in which the impeller is rotated, to increase as much as possible the friction between the discs and water that is pumped and thus the pressure that can be built up within the pump.

The pump 1 also comprises a power shaft 25 coaxial with and rigidly connected to the disc 19 that is opposite to the perforated one. The power shaft is operatively mounted into a bearing assembly 27 and connected to a motor (not shown) via a set of pulleys 29 so as to rotate the impeller 15 within the chamber 5. As is shown, the power shaft 25 extends out of the casing in a direction opposite to the liquid inlet 21.

As already admitted, the structure of the pump 1 disclosed hereinabove is already known per se, except for the use of ribs that are volute shaped and curved radially outwardly.

In accordance with the invention, the above pump 1 is improved in that it incorporates a gas-injection assembly 31 for use to inject and dissolve, at least in part, a gas, especially air, into the liquid while the same is being pumped.

Referring again to FIGS. 1 and 2, the assembly 31 comprises a gas feed pipe 33 coaxial with and rigidly connected to the impeller 15 so as to rotate therewith. The gas feed pipe 33 has a straight portion that extends coaxially through both the liquid inlet 11 and the opening 21 of the disc 17 of the impeller in a direction opposite to the power shaft 25. The end 35 of this straight portion is detachably fixed to the middle of the disc 19 which is already connected to the power shaft 25, thereby causing the requested rigid connection of this feed pipe to the impeller. The gas feed pipe 33 also has another, opposite end defining a gas inlet, which is located outside the casing and operatively connected via a rotary seal joint 37 to a pressurized gas source 39.

The assembly 31 also comprises one or more gas injector pipes 41 rigidly connected to the gas feed pipe near its end 35 so as to rotate in unison therewith and with the impeller 15. When there is one gas injector pipe 41, a counterweight must be provided onto the gas feed pipe 33 to balance the same when it rotates with the impeller. To avoid the use of a counterweight and simultaneously improve the distribution to gas into the liquid that is pumped, use is preferably made of more than one gas injector pipes 41, which are identical in shape and length and symmetrically positioned all around the gas feed pipe 33 so as to extend in a same plane parallel to the discs and be in open communication with the same gas outlet provided in the feed pipe near its end 35. Of course, the number of gas injector pipes 41 that can be used depends on the size of the pump. In practice, use can be made of 3 to 5 injector pipes that are preferably detachably connected to the feed pipe 33 by means known per se, to make their installation and maintenance easier to carry out.

As is shown, each injector pipe 41 is perpendicular to the feed pipe 33 and extends radially within the casing 5 between the ribs 23 of the discs of the impeller. Each injector pipe 41 also has one end in open gas communication with the feed pipe 33 and another radially, opposite end 43 defining a gas nozzle, which opens within the casing between the discs 17, 19 at a radial distance away from the feed pipe 33 that is shorter than the radius of the discs.

As already explained hereinabove, the length of the gas injector pipes may vary depending on the application. The shorter are the gas injector pipes, the lower will be pressure required for injecting air into the pump. However, the longer are the gas injectors, the higher will be the pressure required for injecting air and consequently the amount of air injected into the pump.

The shape and diameter of the gas injector pipes may also vary depending on the application. Thus, instead of being straight, they could be curved. Similarly, instead of having only one opening at their opposite ends, the injector pipes could have a plurality of openings over their length.

Figure 3:
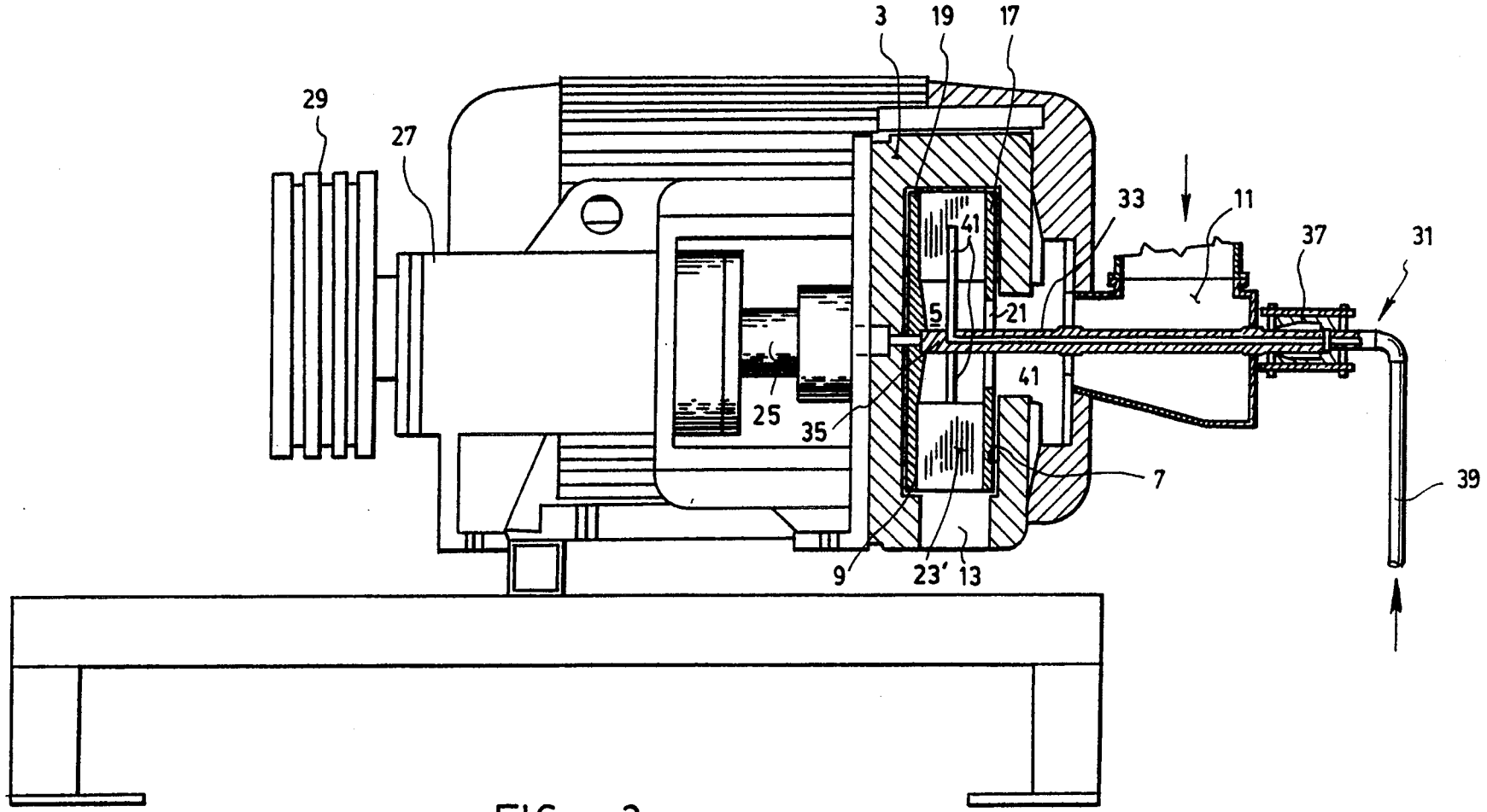
FIG. 3 is a side elevational view, partly in cross-section, of a centrifugal pump of the bladed-impeller type, incorporating a gas injection assembly according to the invention.

FIG. 3 of the drawings shows another embodiment of the invention, which is very similar to the one previously disclosed except that the pump is not of the "rotary disc" type, but of "bladed impeller" type. For the purpose of simplicity, the same reference numerals have been used for identifying the same structural components.

In this embodiment, the impeller 15 also comprises a pair of spaced apart discs 17, 19. However, instead of being connected by rods and provided with ribs, these discs are connected by blades or vanes 23' that are preferably curved and extend radially outwardly away from the opening 21 made in the disc 17 in such a manner as not to interfere with the gas injector pipes 41 that extend between the discs. For this purpose, the injector pipes 41 may be positioned between adjacent vanes 23'.

In the embodiment of FIG. 3, the liquid inlet 11 is L-shaped and the gas feed pipe 33 has its straight portion long enough to extend out of the L-shaped inlet 11 and be connected to the rotary seal joint 37 out of the same. This makes the maintenance of the rotary seal joint 37 much easier to carry out, as the operator has a direct access to it.

A pump of the rotary-disc type like the one shown in FIGS. 1 and 2 was extensively tested by the Applicant for the recirculation of clarified water in a huge, industrial clarifier.

The diameter of the discs of the tested pump was equal to 14" and their spacing equal to 2 ¼". Each disc had five ribs ¾" high. Three air injector pipes were used, whose length was 4". These injector pipes did not interfere whatsoever with the liquid flow. The impeller was rotated at 2100 rpm.

Figure 4:
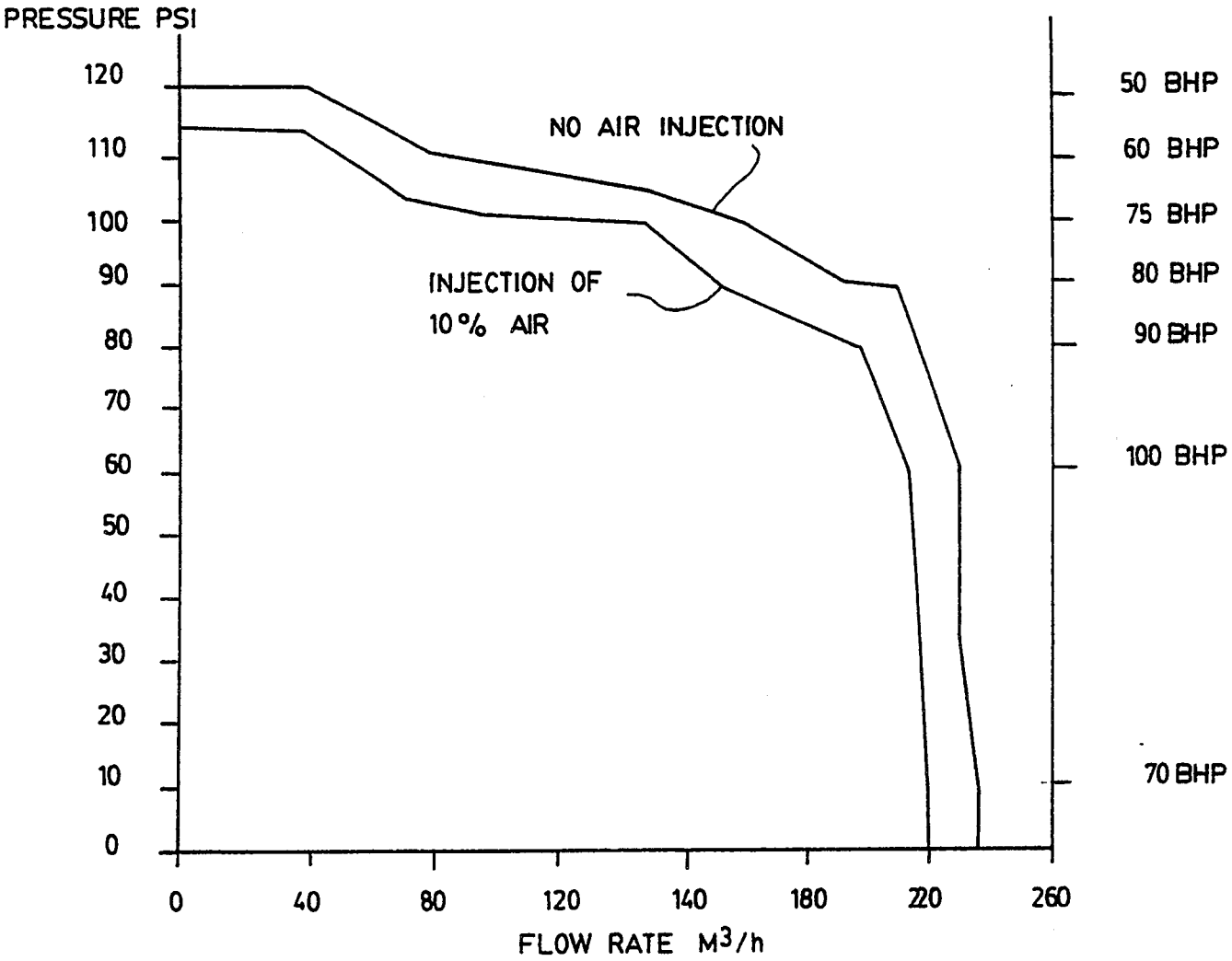
FIG. 4 is a diagram giving the pressure as a function of the flow rate in a pump like the one shown in FIG. 1, with and without injection of air.

The results that were obtained are reported in the diagram shown in FIG. 4. As can be seen, a pressure of more than 80 PSI was easily built up, with a flow rate as high as 190 $m^3/h$. Moreover, up to 15% of air was easily injected into the pumped water, without unduly affecting the efficiency of the pump, using an air pressure source of 30 PSI only.

Of course, numerous modifications can be made to the embodiments disclosed hereinabove without departing from the scope of the instruction as defined in the appended claims.

What is claimed is:

1. In a centrifugal pump for use to pump a liquid, said pump comprising:

a) a casing defining an inner, substantially cylindrical chamber, said chamber having a pair of opposite end walls coaxial with each other;

b) a liquid inlet in open communication with the chamber, said inlet being coaxial with said chamber and opening into one of the opposite end walls thereof;

c) a liquid outlet in open communication with the chamber, said outlet extending tangentially out of said chamber;

d) a rotary impeller rotatably mounted within the chamber, said impeller comprising a pair of spaced apart discs of a given radius coaxial with said chamber, said discs being rigidly interconnected at such a distance away from each other as to extend close to said opposite end walls, respectively, one of said discs located adjacent the one opposite end wall into which said liquid inlet opens having a central opening to allow the liquid injected through said inlet to enter the chamber; and e) a power shaft coaxial with and rigidly connected to the other one of said discs so as to rotate the impeller in a given direction within the chamber, said power shaft extending out of said casing in a direction opposite to said liquid inlet;

the improvement consisting in a gas-injection assembly for use to inject and dissolve, at least in part, a gas into the liquid while said liquid is being pumped, said assembly comprising:

f) a gas feed pipe coaxial with and rigidly connected to the impeller so as to rotate therewith, said gas feed pipe extending coaxially through both the liquid inlet and the opening of the one disc of the impeller in a direction opposite to the power shaft and having a gas inlet located outside said casing and connected through a rotary seal joint to a pressurized gas source, and a gas outlet located within the casing; and g) at least one gas injector pipe rigidly connected to the gas feed pipe so as to rotate in unison therewith and with the impeller to which said gas feed pipe is connected, said at least one injector pipe being perpendicular to said feed pipe and extending radially within said casing between the discs of the impeller, said at least one injector pipe having one end in open communication with the gas outlet of the feed pipe and another radially, opposite end defining a gas nozzle opening within the casing between the discs at a radial distance away from said feed pipe that is shorter than the radius of said discs.

2. The improved centrifugal pump of claim 1, comprising more than one of the said at least one gas injector pipe, which are identical in shape and length and are symmetrically positioned all around said feed pipe so as to extend in a same plane parallel to the discs and to be in open communication with the gas of said feed pipe.

3. The improved centrifugal pump of claim 2, comprising 3 to 5 of said injector pipes.

4. The improved centrifugal pump of claim 2, wherein the impeller comprises vanes that are connected to the discs and extend radially outwardly away from the opening made in the one disc in such a manner as not to interfere with the gas injector pipes extending between said discs.

5. The improved centrifugal pump of claim 2, wherein the discs of the impeller are connected to each other by a plurality of rods and have opposite flat surfaces which face each other and on which a plurality ribs extend, said ribs projecting from said discs at such a distance as to leave a gap in between and then to give room to the gas injector pipes.

6. The improved centrifugal pump of claim 5, wherein said ribs are volute-shaped and radially outwardly curved in a direction opposite to said given direction in which said impeller is rotated.

7. The improved centrifugal pump of claim 6, comprising 3 to 5 of said injector pipes.

8. The improved centrifugal pump of claim 7, wherein said gas feed pipe has one end detachably fixed to the other disc to which is already connected the power shaft thereby causing said rigid connection of said feed pipe to said impeller said gas feed pipe also having another, opposite end operatively connected to said rotary seal joint so as to define said gas inlet.

9. The improved centrifugal pump of claim 8, wherein the liquid inlet is L-shaped and the gas feed pipe has its opposite end that extends out of said L-shaped inlet and is connected to the rotary seal joint out of said L-shaped inlet.

10. The improved centrifugal pump of claim 2, wherein said liquid is waste or clarified water and said gas is air.

11. The improved centrifugal pump of claim 5, wherein said liquid is waste or clarified water and said gas is air.

12. The improved centrifugal pump of claim 6, wherein said liquid is waste or clarified water and said gas is air.

13. The improved centrifugal pump of claim 8, wherein said liquid is waste or clarified water and said gas is air.

14. A method for injecting and dissolving a gas into a liquid while said liquid is being pumped, comprising the steps of:

a) feeding the liquid to be pumped into a centrifugal pump comprising an impeller consisting of two coaxial discs of given radius having facing surfaces which are spaced apart and from which ribs project at such a distance as to leave a gap therebetween and at the same time b) feeding under pressure the gas to be injected and dissolved through at least two symmetrically positioned gas injector pipes extending radially in the gap left between the discs at a radial distance that is shorter than the radius of said discs, said pipes being rigidly connected to the impeller so as to rotate in unison therewith.

15. The method of claim 14, wherein said gas is air and said liquid is waste or clarified water.

16. In a centrifugal pump for use to pump a liquid, said pump comprising:

a) a casing defining an inner, substantially cylinder chamber, said chamber having a pair of opposite end walls coaxial with each other;

b) a liquid inlet in open communication with the chamber, said inlet being coaxial with said chamber and opening into one of the opposite end walls thereof;

c) a liquid outlet in open communication with the chamber, said outlet extending tangentially out of said chamber;

d) a rotary impeller rotatably mounted within the chamber, said impeller comprising a pair of spaced apart discs of a given radius coaxial with said chamber, said discs being rigidly interconnected at such a distance away from each other as to extend close to said opposite end walls, respectively, one of said discs located adjacent the one opposite end wall into which said liquid inlet opens having a central opening to allow the liquid injected through said inlet to enter the chamber; and e) a power shaft coaxial with and rigidly connected to the other one of said discs so as to rotate the impeller in a given direction within the chamber, said power shaft extending out of said casing in a direction opposite to said liquid inlet;

the improvement consisting in a gas-injection assembly for use to inject and dissolve, at least in part, a gas into the liquid while said liquid is being pumped, said assembly comprising:

f) a gas feed pipe coaxial with and rigidly connected to the impeller so as to rotate therewith, said gas feed pipe having a gas inlet located outside said casing and connected through a rotary seal joint to a pressurized gas source, and a gas outlet located within the casing; and g) a plurality of gas injector pipes rigidly connected to the gas feed pipe so as to rotate in unison therewith and with the impeller to which said gas feed pipe is connected, said injector pipes being identical in shape and length and symmetrically positioned all around said gas feed pipe so as to extend radially within said casing between the discs of the impeller in a same plane parallel to said discs.

17. The improved centrifugal pump of claim 16, wherein the discs of the impeller are connected to each other by a plurality of rods and have opposite flat surfaces which face each other and on which a plurality ribs extend, said ribs projecting from said discs at such a distance as to leave a gap in between and then to give room to the gas injector pipes.

18. The improved centrifugal pump of claim 17, wherein said liquid is waste or clarified water and said gas is air.

* * * * *